US005870903A

United States Patent [19]

Meyers et al.

[11] Patent Number: 5,870,903

[45] Date of Patent: Feb. 16, 1999

[54] AIR CIRCULATION UNIT FOR REFRIGERATED CASES

[75] Inventors: Thomas A. Meyers, Minnetonka; Fredric R. Aske, Minneapolis, both of Minn.

[73] Assignee: Stein Industries, Inc., Minneapolis, Minn.

[21] Appl. No.: 698,904

[22] Filed: Aug. 15, 1996

[51] Int. Cl.[6] ..... F25D 17/06; A47F 3/04

[52] U.S. Cl. ..... 62/419; 62/255

[58] Field of Search ..... 62/404, 407, 419–426, 62/89, 246, 249, 251, 255; 414/193, 241, 245, 251

[56] References Cited

U.S. PATENT DOCUMENTS

| | | | |
|---|---|---|---|
| 2,017,781 | 10/1935 | Zedlik | 62/419 |
| 2,087,790 | 7/1937 | Anderson | 62/419 |
| 2,117,570 | 5/1938 | Philipp | 62/419 |
| 2,247,736 | 7/1941 | Tull | 62/419 |
| 2,627,728 | 2/1953 | Levin | 62/419 |
| 2,952,992 | 9/1960 | Voorhies | 62/426 |
| 3,063,252 | 11/1962 | Lamb | 454/193 |
| 3,063,253 | 11/1962 | Dickson et al. | 62/255 |
| 5,357,767 | 10/1994 | Roberts | 62/256 |

*Primary Examiner*—William Doerrler
*Attorney, Agent, or Firm*—Nawrocki, Rooney & Sivertson

[57] ABSTRACT

An air flow circulation device for use in refrigerated display cases. The device is used to provide substantially vertical cooling air flow within refrigerated cases, particularly cases having shelves. The device distributes refrigerated air through the case and particularly to upper and middle shelves.

6 Claims, 3 Drawing Sheets

AIR CIRCULATION UNIT FOR REFRIGERATED CASES

FIELD OF INVENTION

This invention relates generally to refrigerated food display cases. More specifically, this invention provides a device for improving air flow in refrigerated display cases, particularly when shelving units are placed within such cases.

BACKGROUND OF THE INVENTION

Refrigerated display cases are a common feature of modern grocery stores. Typical refrigerated cases have a bottom and four lower sides defining a well, the well serving as a settling area for cool, refrigerated air, and as a display area for food products. Many modern refrigerated cases also have a tall back and top overhang with an open front to allow customers to view, inspect, and retrieve food items.

A refrigerated case having an open front requires carefully regulated air flow to maintain cool temperatures within the case. Cooled air spilling from (or room temperature air being drawn into) the case requires extra cooling. More importantly, improper air flow patterns may result in case temperatures, or temperature variations, which violate food regulations and/or result in spoiled food.

In a typical open-front case, air is pulled through a front or bottom well vent, drawn over a cooing coil within the case, pushed through a channel within the case back, and discharged either through the case back, the case top overhang, or both. Pulling air from the well bottom or front and discharging it through the case back and/or top creates a curtain of cooled air. Ideally, this air flow pattern neither discharges cool air into the room nor pulls warm room air into the case.

Competitive pressures have forced grocers to display (and sell) more goods per square foot. In response to such pressures, grocers have installed shelving units within refrigerated cases, the shelves being typically placed toward the back of the well. Such shelves create more horizontal shelf space. However, the use of such shelves may create cooling problems within the cases.

Many cases are not designed for use with shelves. Also, the food displayed on the shelves requires cool air to maintain safe temperatures. Many cases are incapable of maintaining proper temperature at the upper and middle shelves. Furthermore, the presence of the shelves themselves creates problems as upper shelves shelter lower shelves from descending cooler air and lower shelves shelter upper shelves from circulating lower air.

One approach to more evenly distributing refrigerated air over shelves positioned in a case is essentially a re-building of the cases. One re-building method in use increases the number of fans, so as to boost the total air flow up through the case back and out the top overhang. This increased air flow descending from the case overhang can increase the cooling of upper shelves. In cases where air spills in through back vents in the case, the vents have been removed by replacing the vents with solid sheet metal. By removing the back discharge vents, more air is directed to the top overhang discharge vents. Again, this directs more cooling air to upper shelves.

Adding fans to the case itself and/or blocking vents requires significant re-building of the case at considerable expense. This can require significant down time, lost sales, and often voids the manufacturer's warranty for the case. Adding fans and redirecting air through the case's air passages also has not solved the problem of poor cooling in middle shelves.

SUMMARY OF THE INVENTION

The present invention is an air flow circulation device for use in refrigerated display cases and particularly cases with shelves. More specifically, the device improves air circulation, especially to intermediate shelves.

A device according to the present invention includes a fan or other device for blowing air substantially vertically upward and a structure for supporting the fan to draw refrigerated air from the well of the case. A preferred embodiment fits within a four foot refrigerated case section and has fans sized so as to provide about 37 to about 62 cubic feet per minute per linear foot of refrigerated case. A most preferred embodiment is about 30 inches long, and has three A.C. box fans, each having a capacity of about 37 cubic feet per minute.

The air flow circulation device has been found to provide cool air flow for shelves located high up in the case. The present invention has also been found to provide cooling air flow for all shelves in a suitable shelving unit, including middle shelves often sheltered from upper and lower air flow in conventional refrigerated cases, including those modified as described above.

DESCRIPTION OF THE PREFERRED EMBODIMENTS

Figure 1:
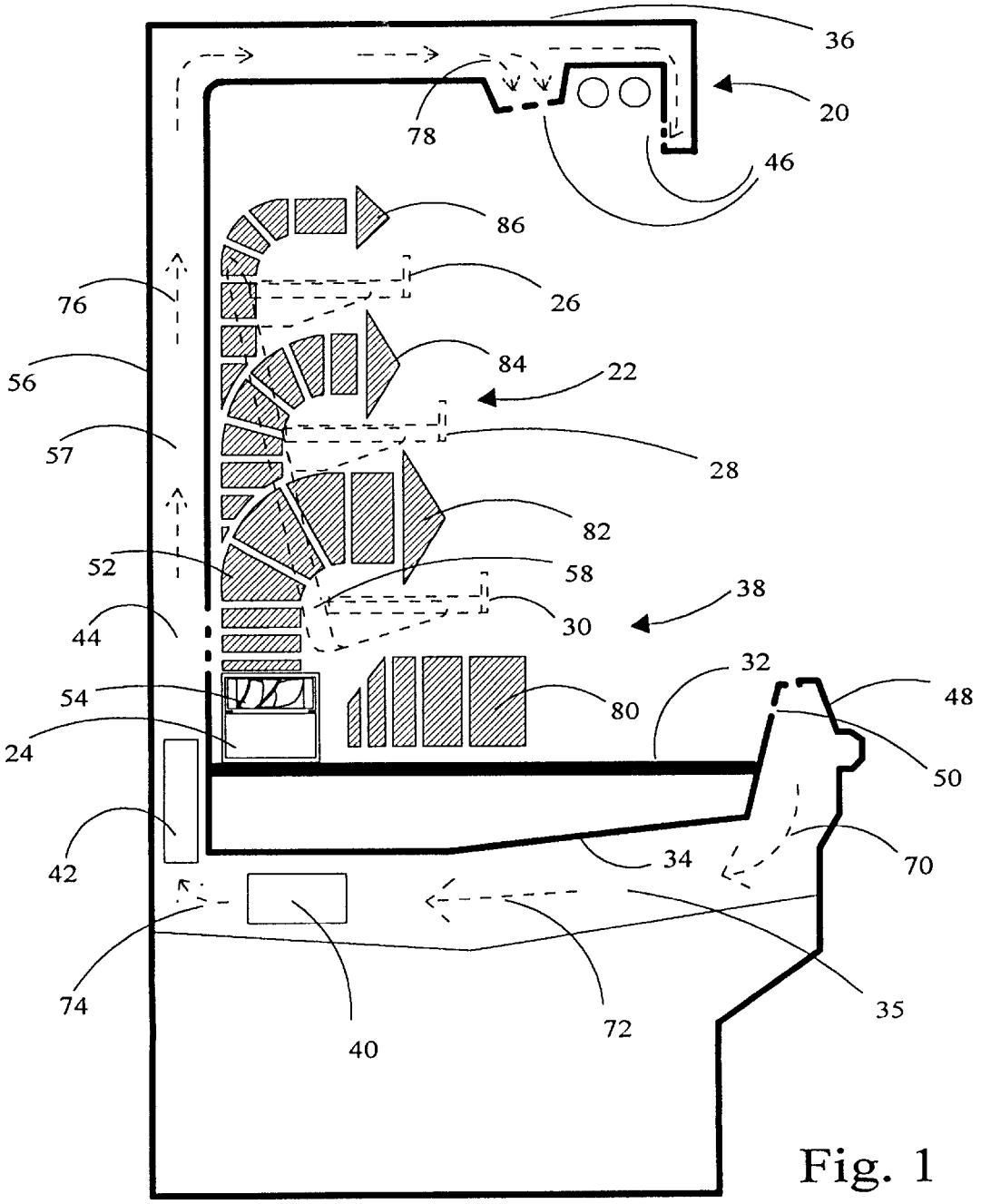
FIG. 1 is a side cross sectional view of a typical refrigerated case having shelving unit and air flow circulation device in accordance with the present invention.

FIG. 1 illustrates a preferred embodiment of the present invention. Shown is a refrigerated case 20 having a removable shelving unit 22 (shown in phantom) and an air flow circulation unit 24. Refrigerated case 20 typically has air taken in through front air intake vents 50 located in a front lip 48, which flows downward as indicated at 70 and through bottom channel 35. Air at 72 is pulled through a cooling fan 40, forced through a cooling coil 42, and further forced up within a passage or channel 57 within case back 56, where some air may be discharged through back discharge vents 44. The remaining air is forced further up as indicated at 76, then forward, through a top overhang 36 as indicated at 78, and down through top overhang discharge vents 46. The cooled air cascades down through case 20 and is ultimately collected through front air intake vents 50, thereby creating an air curtain.

Refrigerated case 20 has a bottom portion generally referred to as a well 38, defined by front lip 48, sides (not shown), and the lower portion of back 56. Case 20 further has a false bottom 32 over a bottom 34, used to provide varying depth of goods and drainage. Refrigerated cases vary in design, with some having no back discharge vents 44 and others having air intake from within well 38 or bottom 34 rather than, or in addition to, front air intake vents.

The shelving unit 22 shown has vertical supports 52, sides 58, an upper shelf 26, a middle shelf 28, and a lower shelf 30. In FIG. 1 it is evident that middle shelf 28 is partially blocked from upper cooler air flow by upper shelf 26 and partially blocked from lower cooler air by lower shelf 30. Further, the tendency of heated air to rise combined with the location of upper shelf 26 compounds the problem.

Specifically, heated air tends to pool in the space occupied by upper shelf 26, causing temperatures warmer than desired for refrigerating food.

Air flow circulation unit 24 having an air flow fan 54 is illustrated resting in well 38 on false bottom 32. Refrigerated air is drawn from the well by air flow circulation unit 24 as indicated by arrows 80 and forced upward into case 20.

Shelving unit 22 is shown being open to air flow through the shelf back, enhancing cooling of the shelves when used in conjunction with air flow circulator 24. That is, lower shelf 30 is located forward of middle shelf 28 which is located forward of upper shelf 26. Such an arrangement of shelves channels air flow upward to lower shelf 30, middle shelf 28 and upper shelf 26, indicated by arrows 82, 84 and 86 respectively.

Figure 2:
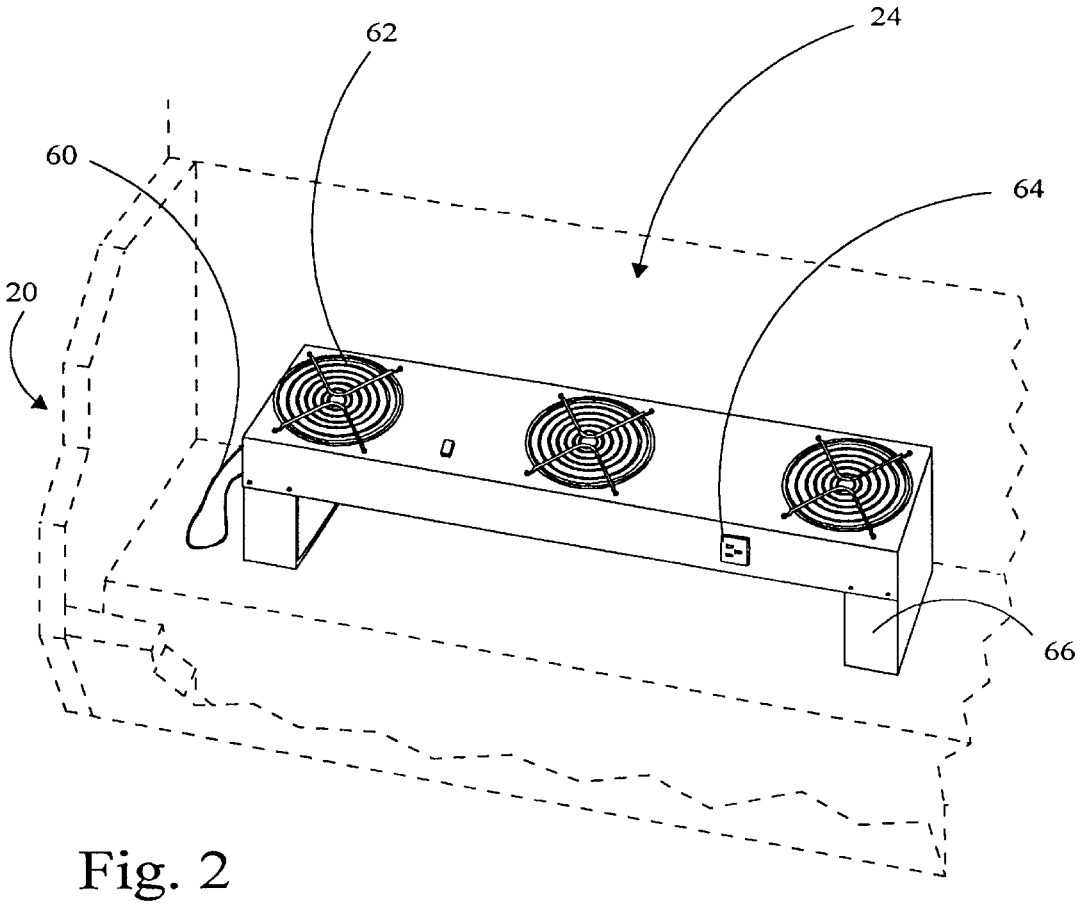
FIG. 2 is a perspective view of an air flow device in accordance with the present invention in place in the well of a refrigerated case shown in phantom.

FIG. 2 illustrates air flow circulation unit 24 setting in refrigerated case 20, the case 20 being shown in phantom. Air flow circulation unit 24 is powered via a conventional power outlet by power cord 60 and is able to power another unit through outlet 64. Air through unit 24 is pulled through the air space beneath the unit provided by standoffs 66. Protection against finger injury by fan blades is provided by top grills 62.

Figure 3:
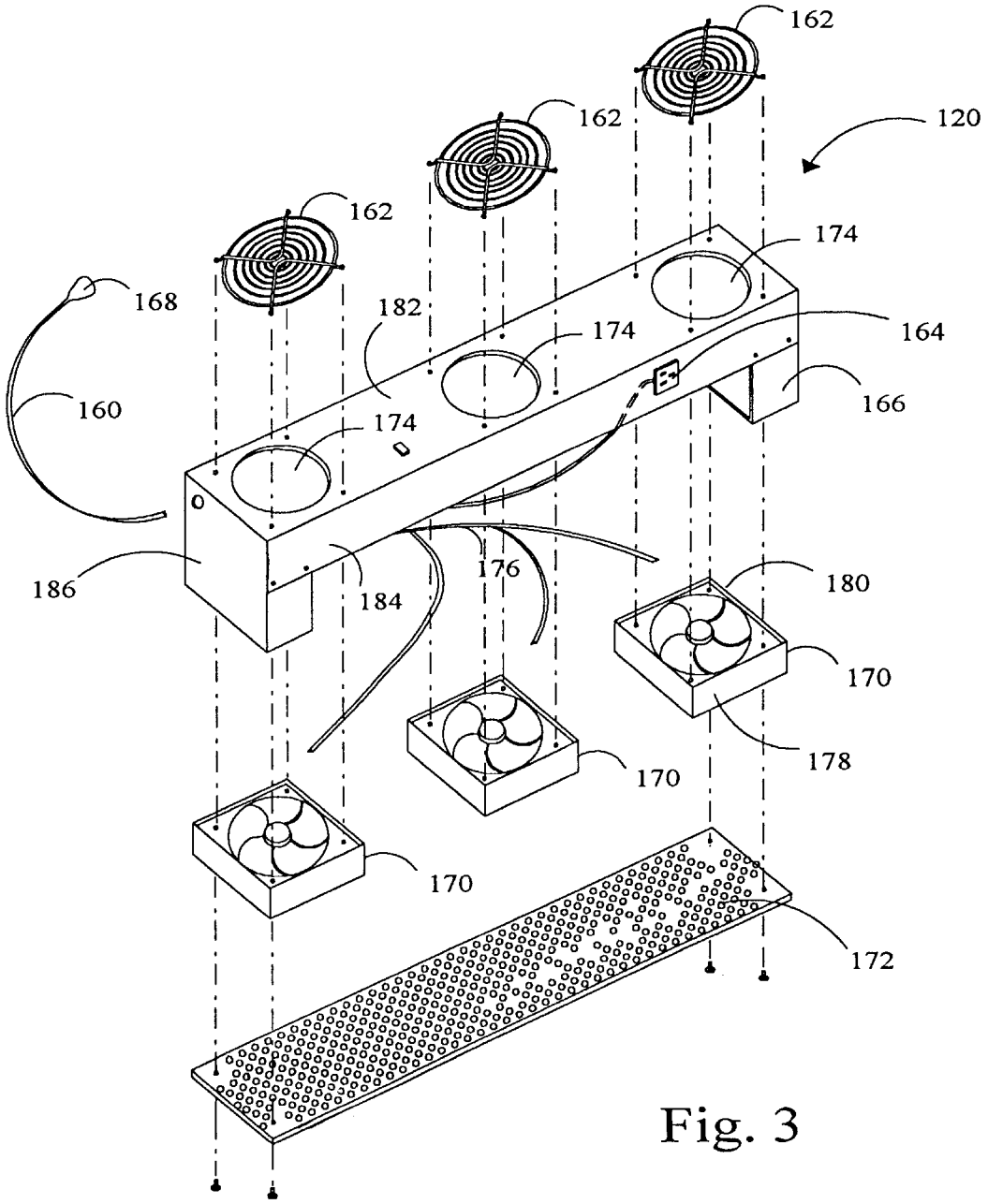
FIG. 3 is an exploded view of the air flow device of FIGS. 1 and 2.

FIG. 3 illustrates an exploded view of a preferred embodiment of an air flow circulation unit in accordance with the present invention and designated 120. Unit 120 includes openings 174 and box fans 170, each fan having a supply side 178 and discharge side 180. Top grills 162 provide finger protection from fans 170 as does bottom grill 172. Top grills 162 are of conventional design, and can be made of perforated metal or heavy gauge metal wire. Bottom grill 172 is of conventional design also, and can be made of sheet metal having perforations to allow for air flow. The body of air flow circulator 120 is formed from sheet metal in a rectilinear box having a top 182, front 184, sides 186, and back (not shown). Air is pulled in through bottom grill 172 by fans 170, and forced out through openings 174 and top grills 162. Power to fans 170 is provided by plug 168, power cord 160, and wiring 176. Power may be provided in turn to another unit through outlet 164.

While any number of fans may be used within the scope of the invention, the preferred embodiment has three fans. Three fans have been found to provide air flow at both ends and the middle of an air flow unit, providing relatively uniform upward air flow. In a most preferred embodiment of the invention, the fans are sized to provide air flow of about 37 to about 62 cubic feet per minute per linear foot of refrigerated case. Air flow substantially less than the lower limit has been found to insufficiently cool upper shelves of shelving units. Air flow substantially greater than the upper limit has been found to spill air out of the case and/or draw ambient air into the case. A most preferred embodiment of the invention is 30 inches long, suitable for installation into a four foot refrigerated case section. This embodiment of the invention has three fans and 76 cubic feet per minute capacity. A preferred embodiment utilizes A.C. fans, compatible with plugging the unit into A.C. outlets in or near refrigerated cases or on an adjacent unit.

An alternative embodiment, not shown, utilizes a single fan, and discharges air substantially vertically upward through multiple discharge vents disposed along the top of the air circulation unit.

In the experiments tabulated below, an existing refrigerated case was fitted with an air flow circulator and a shelving unit having three shelves. The "bottom" space is below the lower shelf. No additional cooling capacity other than the air-circulator of the present invention was added. As can be seen in the results, temperatures were significantly reduced in the middle and upper shelves. A typical maximum temperature allowed by state codes is 45 degrees F. for many food products. As is demonstrated by the data, middle and upper shelf temperatures are significantly above this maximum without installation of the air flow units. With addition of the units, shelf temperatures become both lower and more uniform.

Experimental Results

Experiment 1;
Refrigerated case: Hussman PH

| Shelf | Without Air flow Circulator | With Air flow Circulator |
|---|---|---|
| Upper | 59–60 degrees F. | 39–40 degrees F. |
| Middle | 49 degrees F. | 39–40 degrees F. |
| Lower | 41 degrees F. | 41 degrees F. |
| Bottom | 38–39 degrees F. | 38–39 degrees F. |

Experiment 2:
Refrigerated case: Kysor Warren HZV

| Shelf | Without Air flow Circulator | With Air flow Circulator |
|---|---|---|
| Upper | 55–57 degrees F. | 43–44 degrees F. |
| Middle | 51–53 degrees F. | 44 degrees F. |
| Lower | 47–49 degrees F. | 44 degrees F. |
| Bottom | 44–45 degrees F. | 46–47 degrees F. |

Numerous characteristics and advantages of the present invention have been set forth in the forgoing description. It will be understood, however, that this disclosure is, in many respects, only illustrative. Changes may be made in details, particularly in matters of shape, size, and arrangement of parts without exceeding the scope of the invention. The invention's scope is, of course, defined in the language in which the appended claims are expressed.

What is claimed is:

1. An air flow circulation device for use in a refrigerated case, said case having a bottom, front, sides, and back, comprising:

a plurality of fans each having a supply side and a discharge side for forcing air substantially vertically upward, said fans being oriented with said supply side downward and said discharge side upward; and means supporting said plurality of fans within said case for drawing refrigerated air from said case, said supporting means comprising a substantially horizontally oriented top surface having at least one discharge opening for each fan and further comprising a plurality of standoffs beneath said supporting means.

2. An air flow device as recited in claim 1, wherein said front defines a linear foot dimension, and said air forcing means forces air at a rate of about 37 to about 62 cubic feet per minute per linear foot of refrigerated case.

3. A refrigerated case air flow device as recited in claim 1, wherein said plurality of fans comprise at least three fans.

4. A refrigerated case air flow device as recited in claim 1, wherein said plurality of fans comprise at least three box fans.

5. A refrigerated case air flow device as recited in claim 3, wherein:

said support means further comprises a rectilinear box having a top, front side, back side, right side and left side, said bottom being open.

6. A refrigerated case air flow device as recited in claim 1 wherein said air flow device has a length of about thirty inches.

* * * * *